US006190084B1

(12) United States Patent
Ibañez

(10) Patent No.: US 6,190,084 B1
(45) Date of Patent: Feb. 20, 2001

(54) MODULAR SEPARATING BARRIER ELEMENT

(75) Inventor: Pere Mares Ibañez, Moncada I Reixach (ES)

(73) Assignee: Construcciones Mecánicas Marés, S.A., Barcelona (ES)

( * ) Notice: Under 35 U.S.C. 154(b), the term of this patent shall be extended for 0 days.

(21) Appl. No.: 09/198,893

(22) Filed: Nov. 24, 1998

(30) Foreign Application Priority Data

May 12, 1998 (ES) ..... 9800987

(51) Int. Cl.[7] ..... E01F 15/00; E01F 9/00

(52) U.S. Cl. ..... 404/6; 404/9; 256/13.1; 160/351

(58) Field of Search ..... 256/1, 19, 24, 256/25, 26, 13.1, 73, DIG. 6; 404/6, 9; 160/351

(56) References Cited

U.S. PATENT DOCUMENTS

| | | | | |
|---|---|---|---|---|
| D. 398,404 | * | 9/1998 | Hope | D25/50 |
| 1,677,693 | * | 7/1928 | Trufant | 256/1 |
| 3,305,221 | * | 2/1967 | Kling | 256/24 X |
| 4,844,424 | * | 7/1989 | Knudslien | 256/26 |
| 4,930,752 | * | 6/1990 | Wolper, Jr. | 256/13.1 |
| 5,078,367 | * | 1/1992 | Simpson et al. | 256/19 X |
| 5,402,988 | * | 4/1995 | Eisele | 256/24 |
| 5,544,614 | | 8/1996 | Cushman | 116/63 P |
| 5,609,327 | * | 3/1997 | Amidon | 256/24 |
| 5,661,944 | * | 9/1997 | Specht . | |
| 5,875,597 | * | 3/1999 | Gingrich et al. . | |

FOREIGN PATENT DOCUMENTS

| | | |
|---|---|---|
| 0 120 795 | 10/1994 | (EP) . |
| 2704879 | 11/1994 | (FR) . |

* cited by examiner

*Primary Examiner*—Eileen D. Lillis
*Assistant Examiner*—Gary S. Hartmann
(74) *Attorney, Agent, or Firm*—Darby & Darby

(57) ABSTRACT

A modular separating barrier element including a frame of generally rectangular structure which is molded from synthetic material and which borders an inner panel having plain regions and regions having perforations and other regions having reinforcing ribs. Detachable feet are coupled rotatably to the lower ends of the shorter sides of the structure of the element. The shorter sides have elements for complementary coupling with other elements of adjacent barriers. Each of the shorter sides may include a pair of projections, those of one of the sides having respective vertical through-holes and those of the other side having respective pairs of coaxial rods which extend vertically and which can be fitted in the holes of the projections of an adjacent barrier element.

11 Claims, 9 Drawing Sheets

MODULAR SEPARATING BARRIER ELEMENT

BACKGROUND OF THE INVENTION

1. Field of the Invention

The present invention is intended to disclose a novel element for forming separating barriers for various applications, having characteristics of novelty and inventive activity in comparison with the prior art.

Boundary barriers of many types are currently used for separating traffic or pedestrian zones for various purposes, for example, as boundaries for work zones, for public functions, etc.

2. Description of Related Art

Currently-known barriers are mainly self-supporting metal barriers which have a grid structure of bars or the like. The said barrier elements suffer from various shortcomings, the most important being their great weight which makes their transportation complex and expensive and makes them difficult to handle at the place of use in order to separate the zones fenced off.

The present invention is intended to solve the above-mentioned problems, providing a modular separating barrier element which has novel characteristics of light weight, easy orientation of the feet for bearing on the ground, and connection means with which greater stability and connectability of the various elements making up the separating barrier is achieved. At the same time, the separating barrier element of the present invention has specific characteristics which enable it to receive advertising material and notices, which represents a novel use of barrier elements of this type.

SUMMARY OF THE INVENTION

To achieve its objects, the separating barrier element of the present invention is includes a surrounding frame, preferably of elongate rectangular structure, of which the longer sides define the upper edge and the lower edge of the barrier element and the shorter sides have, at their lower ends, the rotatable supporting feet of the barrier element, the space bordered by the rectangular frame being occupied wholly or partially by closure panels which may be plain or may have openings of various types for reducing weight and minimizing the effect of wind. According to one characteristic of the present invention, the surrounding frame of the barrier element has a hollow structure, this characteristic enabling the frame to be manufactured from a plastics material by gas injection molding.

The substantially rectangular body of the barrier element preferably has lower bracket-like portions for increasing strength in the vicinity of the feet and has swivel coupling of the support feet, thus enabling the feet to adopt the most suitable position for supporting the barrier element.

The shorter sides of the modular barrier element have elements in the form of complementary recesses and projections for permitting easy coupling of the various barrier elements making up a complete barrier.

The material used for the manufacture of the barrier element of the present invention may vary but is preferably any easily moldable synthetic resin having weather-resistance characteristics.

Given the characteristics of the present invention it is also applicable to sports hurdles such as the hurdles used in various sports for jumping competitions and the like.

To improve the coupling of the modular barrier elements of the present invention, in a variant, there is provision for a particular construction of the side edges of the barrier elements according to which, on one of the sides, the barrier element has strong horizontal projections which have upper and lower rods of considerable length which, in combination with projection of similar elements disposed on the opposite sides an having holes for receiving the said rods, enable two adjacent modular elements to be connected, even if one of them is at a higher level than the other, which occurs when one of the said elements is on the roadway and the other on the pavement beside the roadway.

The vertical positions of the said projections on the sides of the barrier elements are slightly offset on one lateral edge relative to the other to enable the vertical rods of one of the edges to be fitted in the holes in the other.

BRIEF DESCRIPTION OF THE DRAWING

For a better understanding, some drawings of a barrier element formed in accordance with the present invention are appended by way of non-limiting example.

DETAILED DESCRIPTION OF THE PREFERRED EMBODIMENTS

Figure 1:
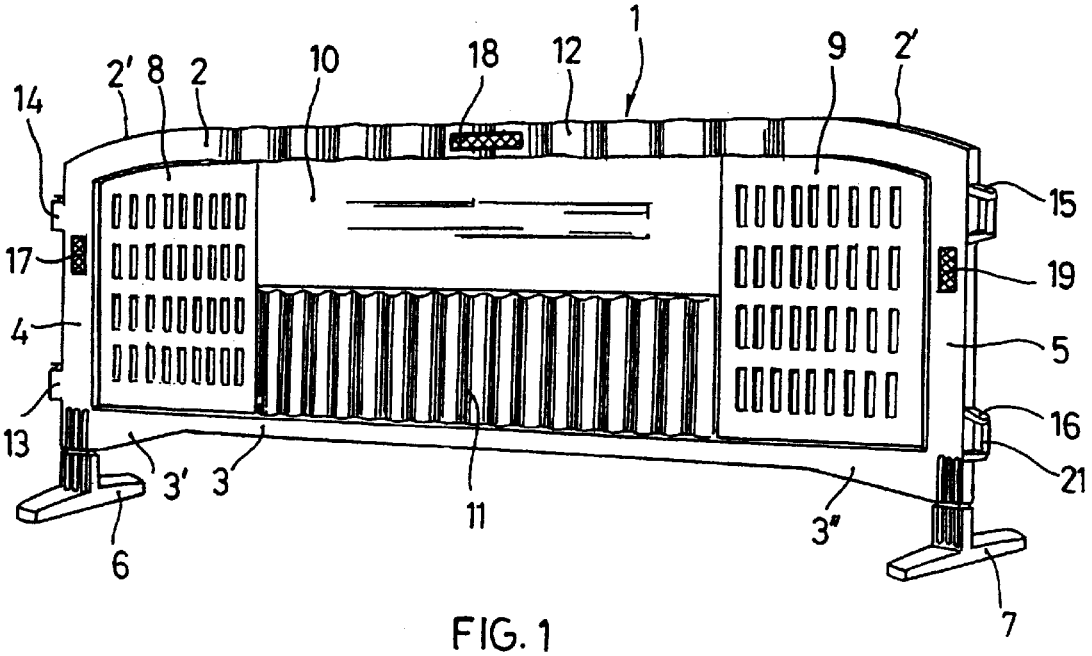
FIG. 1 is a perspective view of a modular barrier element formed in accordance with the present invention.
Figure 2:
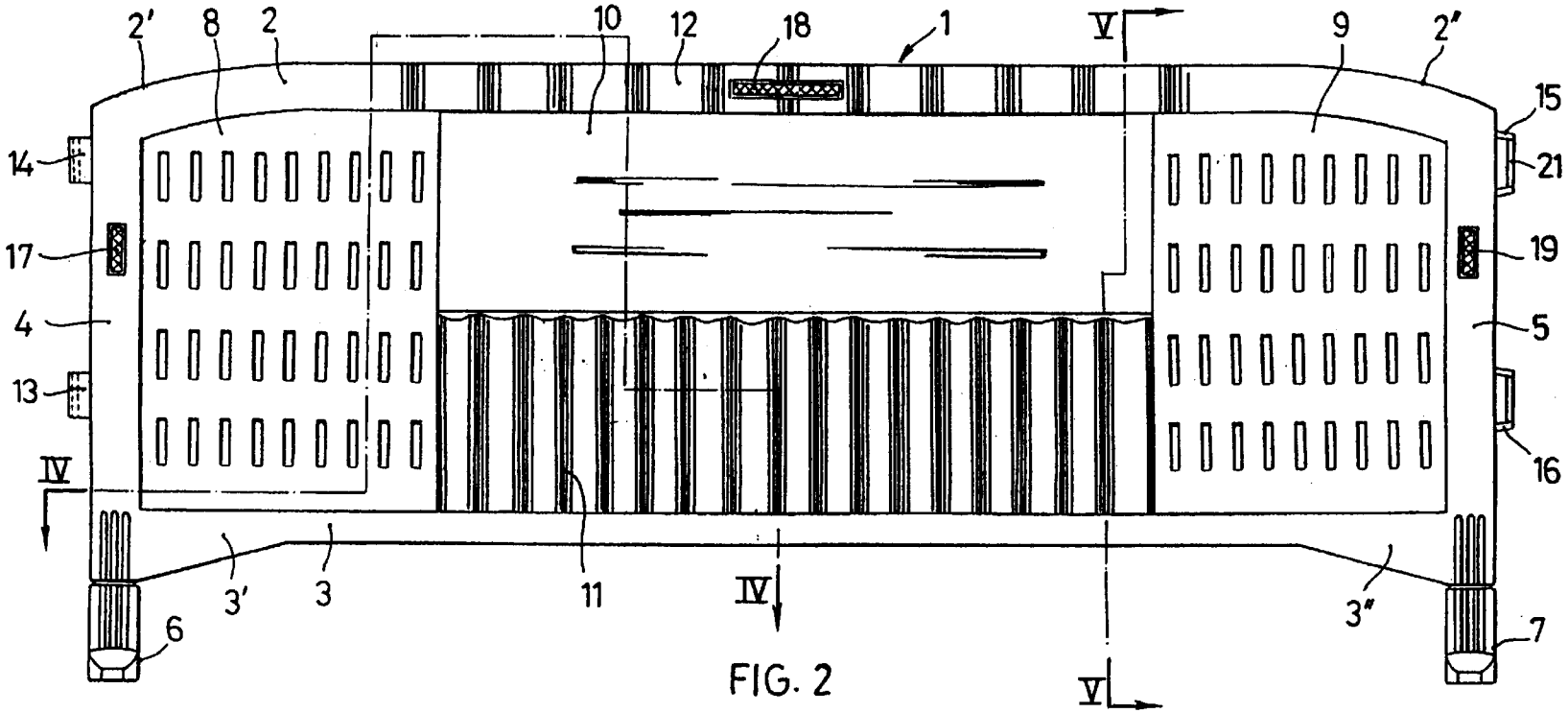
FIGS. 2 and 3 are a front elevational view and a plan view of the barrier element of FIG. 1, respectively.

As can be appreciated from the drawings, the modular barrier element according to the present invention comprises a body 1 of generally rectangular structure having a peripheral frame with upper and lower longer longitudinal sides 2 and 3 and shorter lateral sides 4 and 5 having lower orientable feet 6 and 7 rotatable about respective vertical pivot pins incorporated in the said shorter sides. Although from the point of view of the design of the barrier element many variations may be introduced, the preferred embodiment shown in the drawings comprises upper regions such as 2' and 2" which are curved in the vicinity of the ends, and lower bracket-like portions 3' and 3" for increasing strength in the regions of the coupling of the rotatable feet 6 and 7.

The inner portion bordered by the outer frame is occupied by a molded plate which may have end panels 8 and 9 having a plurality of openings and a plain panel 10 which can receive advertising inscriptions or various other signs. Similarly, some of the parts of the panel, such as the lower portion 11 adjacent the plain region 10, may receive a corrugated structure for increasing the strength of the element.

In general, it is preferable to provide the intermediate panel with a region having ribs which may be constituted by a corrugated profile.

The corrugated arrangement mentioned may also be produced in the form of transverse ribs on any of the sides, as shown for the region 12 of the upper side 2.

The structure of the sides 2, 3, 4 and 5 of the barrier element is preferably hollow, preferably having been produced by gas injection moulding. A lighter weight of the barrier element is thus achieved.

According to a variant of the present invention, the barrier element and, in particular, some of the sides of the peripheral frame, may be formed in accordance with the so-called two-material technique, that is, by co-extrusion of two materials, with the use, in the case of the present invention, of a recycled plastics material for the interior of the body of the barrier element and a finishing material, which will have the desired material color and quality characteristics, for the exterior.

This two-material arrangement with recycled material in the core or inner portion of the body of the barrier element enables recycled synthetic materials to be re-used with the clear ecological advantage of utilizing waste material.

To improve the visibility of the barrier element, it may be manufactured in synthetic materials of colors such as yellow which are clearly visible in conditions of reduced visibility, possibly complemented with reflecting regions such as 17, 18 and 19 in different portions of the barrier element, particularly in its outer frame.

In order to form a complete barrier, several barrier elements 1 are connected to one another, for which purpose the shorter sides such as 4 and 5 have coupling regions, for example, projections of variable structure with cavities on one shorter side and projections complementary to the cavities on the other side, such as those indicated 13 and 14 for the side 4 and those indicated 15 and 16 on the side 5, forming articulated couplings. The said projections may also include through-holes for connection elements of variable types enabling a barrier of variable length to be formed by the interconnection of a plurality of successive elements of the type described.

Figure 3:
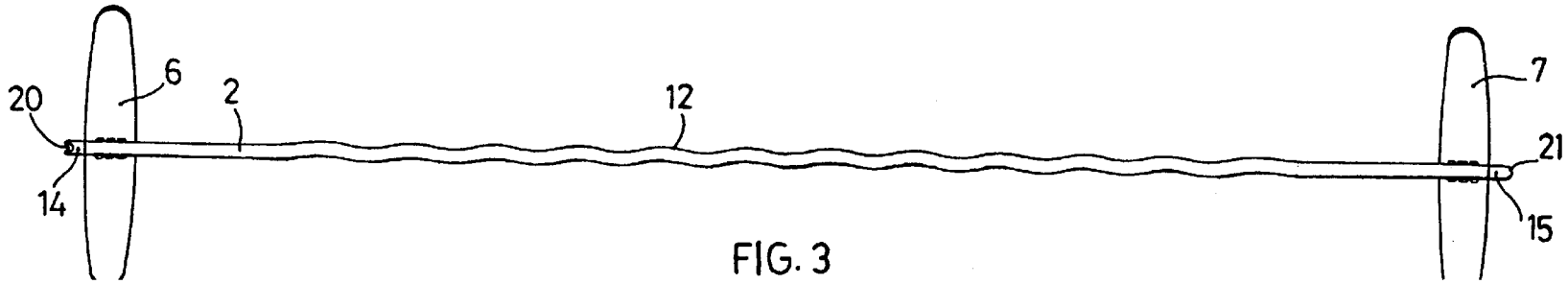
Figure 4:
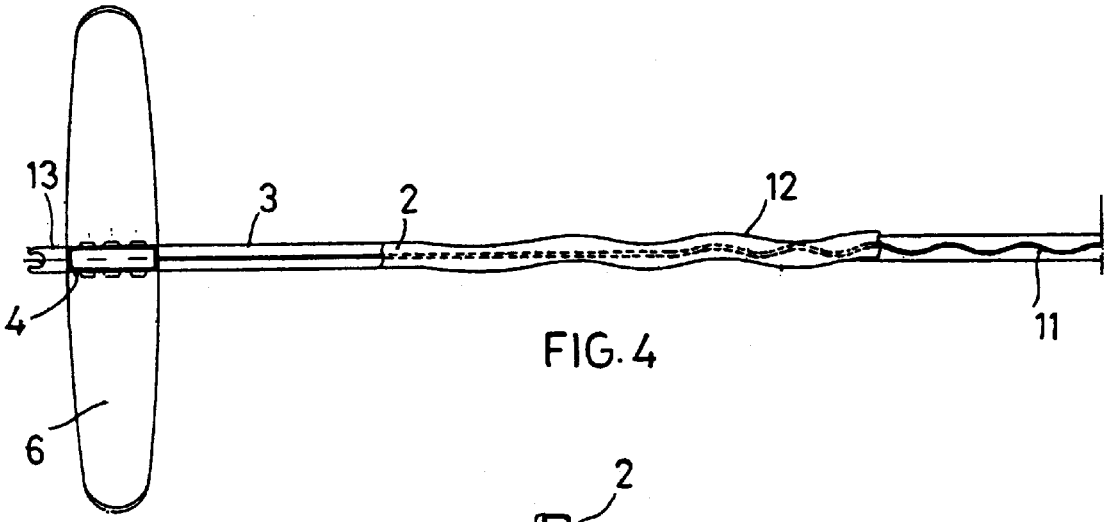
FIGS. 4 and 5 are respective details sectioned in the planes indicated.
Figure 5:
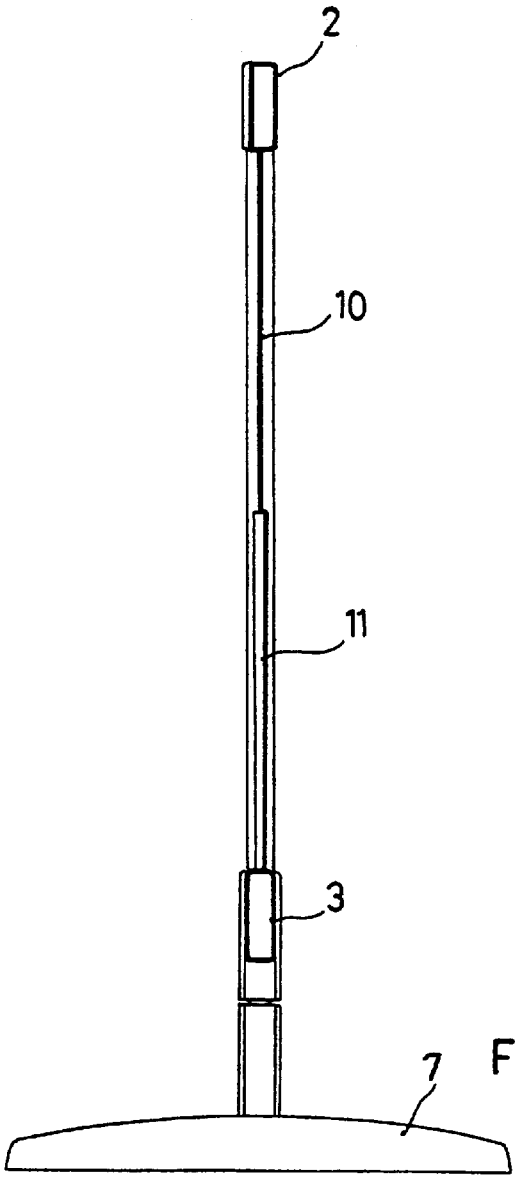
Figure 6:
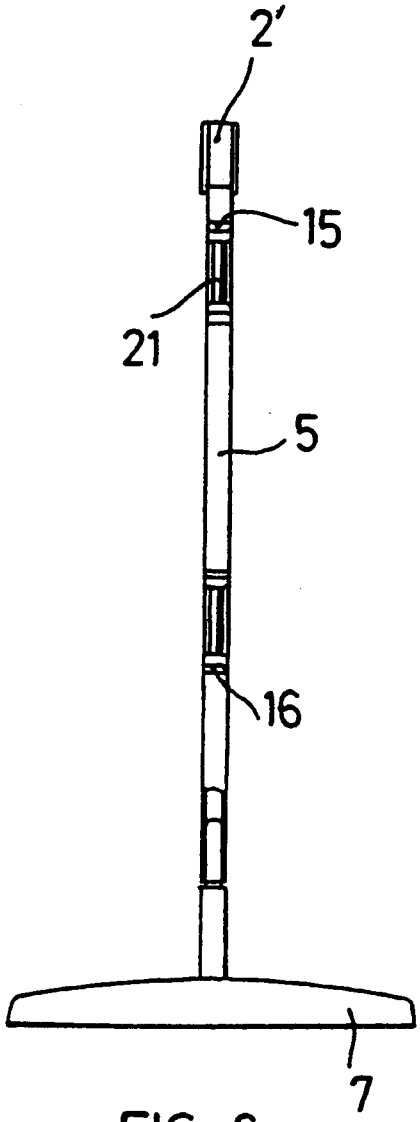
FIG. 6 is an elevational view showing the barrier element from one end.
Figure 7:
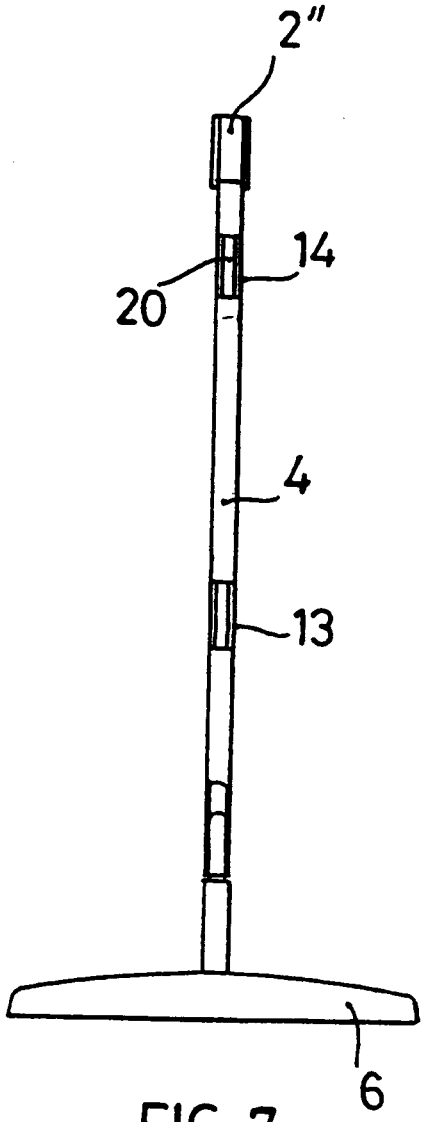
FIG. 7 is a side elevational view from the opposite end to that of FIG. 6.
Figure 8:
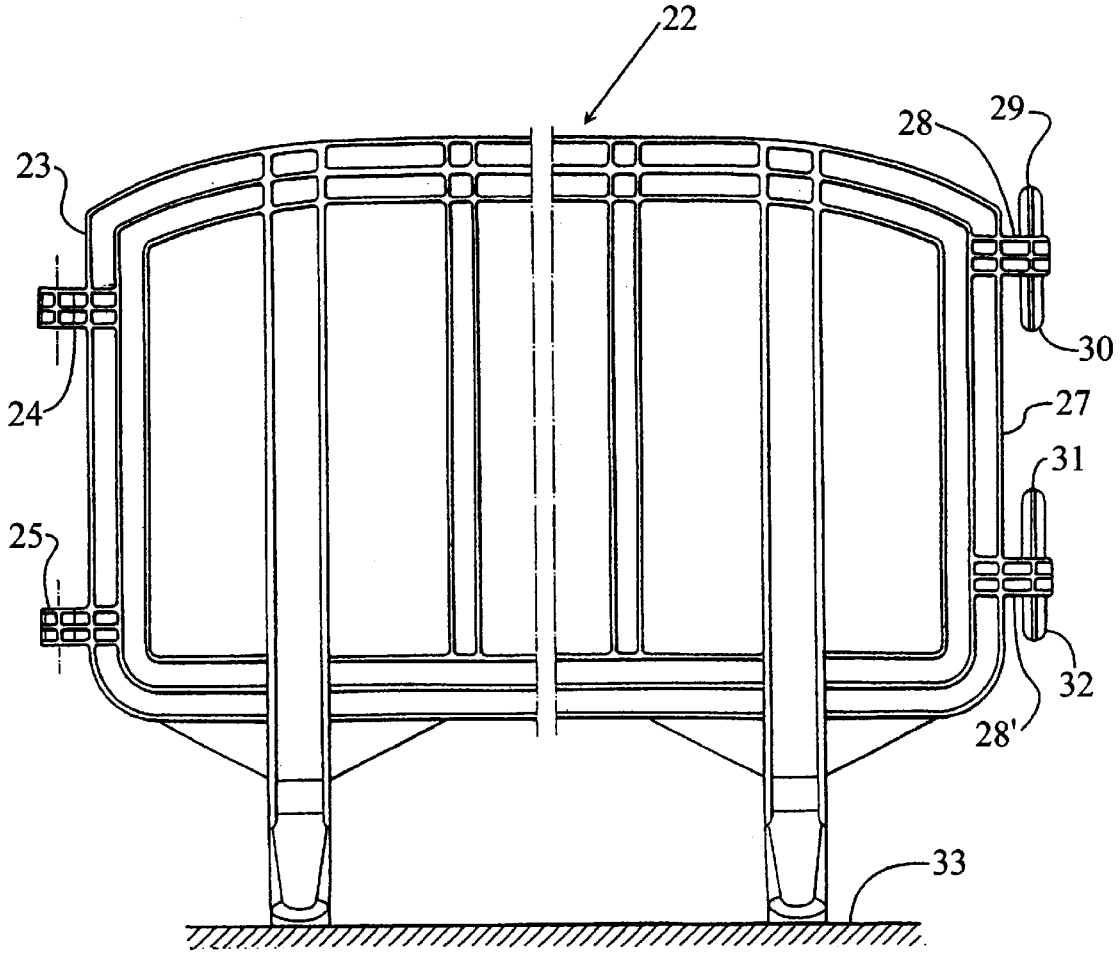
FIG. 8 is a front elevational view of a modular separating barrier element which incorporates the present improvements.

One embodiment of the said couplings can be see in FIGS. 3, 6 and 7, the projections 13, 14 as well as 15 and 16 forming complementary recesses and projection, as can be seen in FIG. 3 in which the recessed shape 20 in a projection on one side and the projecting shape 21 in a projection of the other side can be seen; these can be fitted one inside the other by pressure with a capability for articulation, constituting an easy method of extending the barrier.

Figure 9:
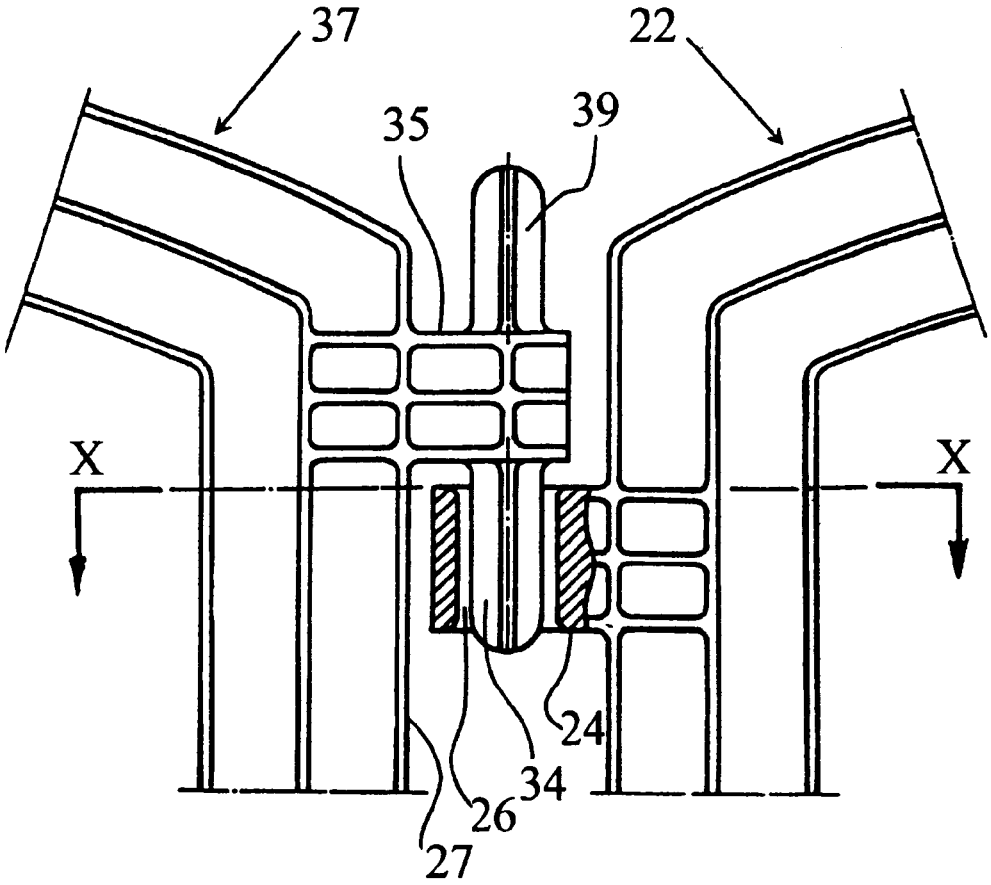
FIGS. 9 and 10 are views which show in detail and in section the articulation of a modular barrier element to another located in an adjacent position.

In the variant of FIGS. 8 to 13, the barrier element 22 has, on one of its side edges 23, two horizontal projections 24 and 25 having through-holes such as the hole 26 shown in FIG. 9 corresponding to the lateral projection 24, whereas the opposite side 27 has a further two projections 28 and 28' having respective pairs of rods 29, 30 and 31, 32, coaxial with one another and perpendicular to the projections 28 and 28', that is, corresponding to a vertical position when the barrier element 22 is supported on a horizontal surface 33.

The pairs of projections 29, 30 and 31, 32 of one of the sides are intended to be fitted into the recesses of an adjoining element in order to achieve articulation thereof as shown, for example, in FIG. 9 which shows the projection 24 having the hole 26, which receives the rod 34 of a corresponding projection 35 of an adjoining barrier element 37, which is articulated to the adjacent element, indicated 22.

Figure 11:
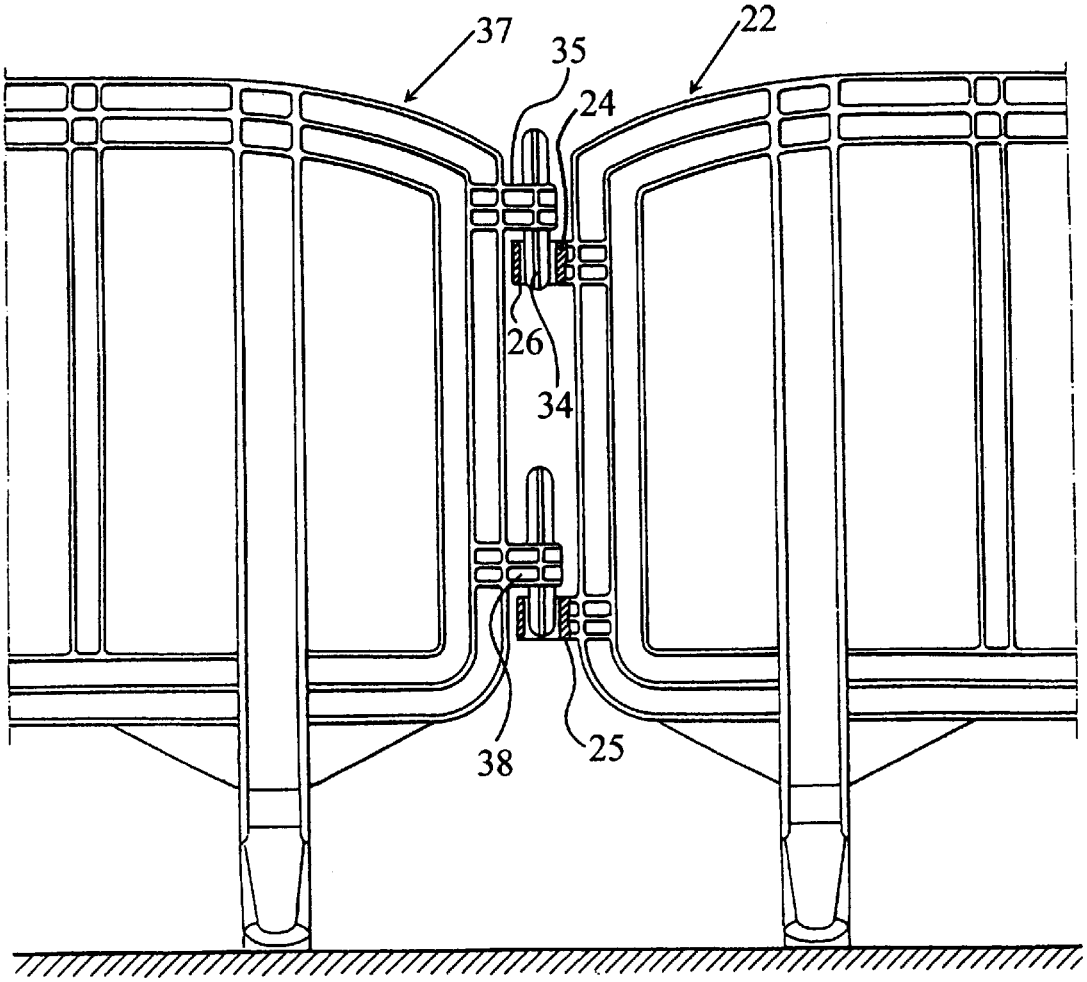
FIG. 11 is a partially-sectioned front elevational view of two barrier elements coupled on a flat surface.

The relative positions of the two barrier elements 22 and 37 articulated to one another when both barrier elements are disposed on horizontal ground can be seen in FIG. 11, in which the coupling of the rods of the barrier element 37 in the holes of the opposed projections 24 and 25 of the barrier element 22 can be appreciated. In this drawing, it can be appreciated that, in addition to the rod of the upper projection 35, the fitting and articulation is also achieved by the rod of the lower projection, indicated 38, of the barrier element 37.

As indicated above, the heights of the projections having holes are offset vertically relative to the projections carrying the rods in order to enable the projections to be coupled and, depending on circumstances, to be kept at the same level.

In each of the projections carrying rods, for example, the projection 35 of the barrier element 37, the lower or inner rod element 34 is longer than the coaxial rod 39 on the upper or outer side. By virtue of this arrangement, the two inner rods are longer than the two outer rods of one side of a barrier element.

Figure 10:
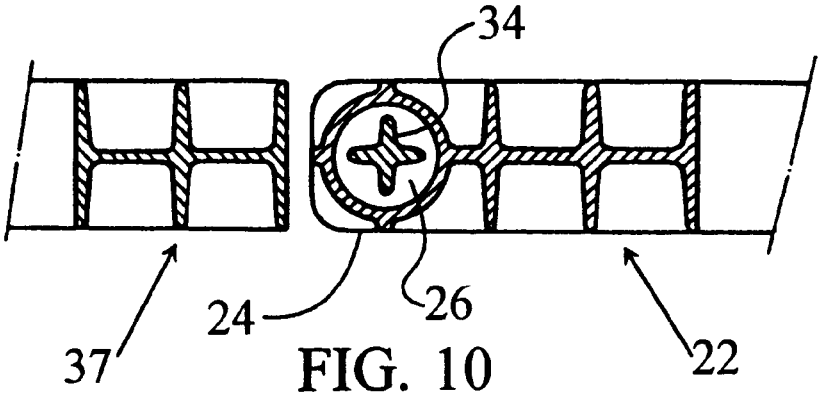

The specific structure of the rods may vary although the ribbed structure indicated in FIG. 10, in which an embodiment with a cross-shaped cross-section is shown, may be favourable; clearly, however, the cross-section may be of another type.

The ends of the rods are preferably rounded to facilitate handling and coupling of the barrier elements.

Figure 12:
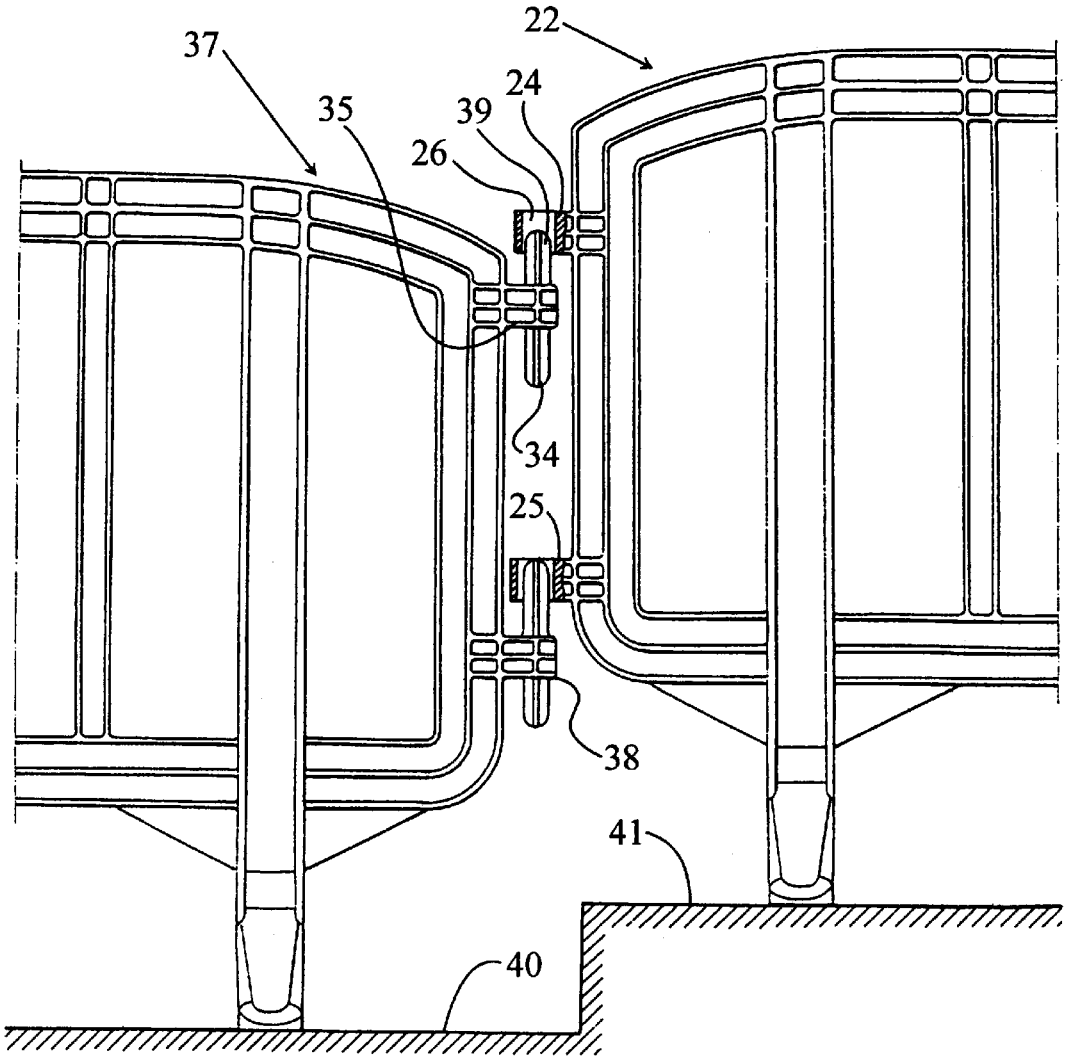
FIG. 12 is a view similar to FIG. 11 with the two adjacent modular barrier elements at different levels, in the coupling position.
Figure 13:
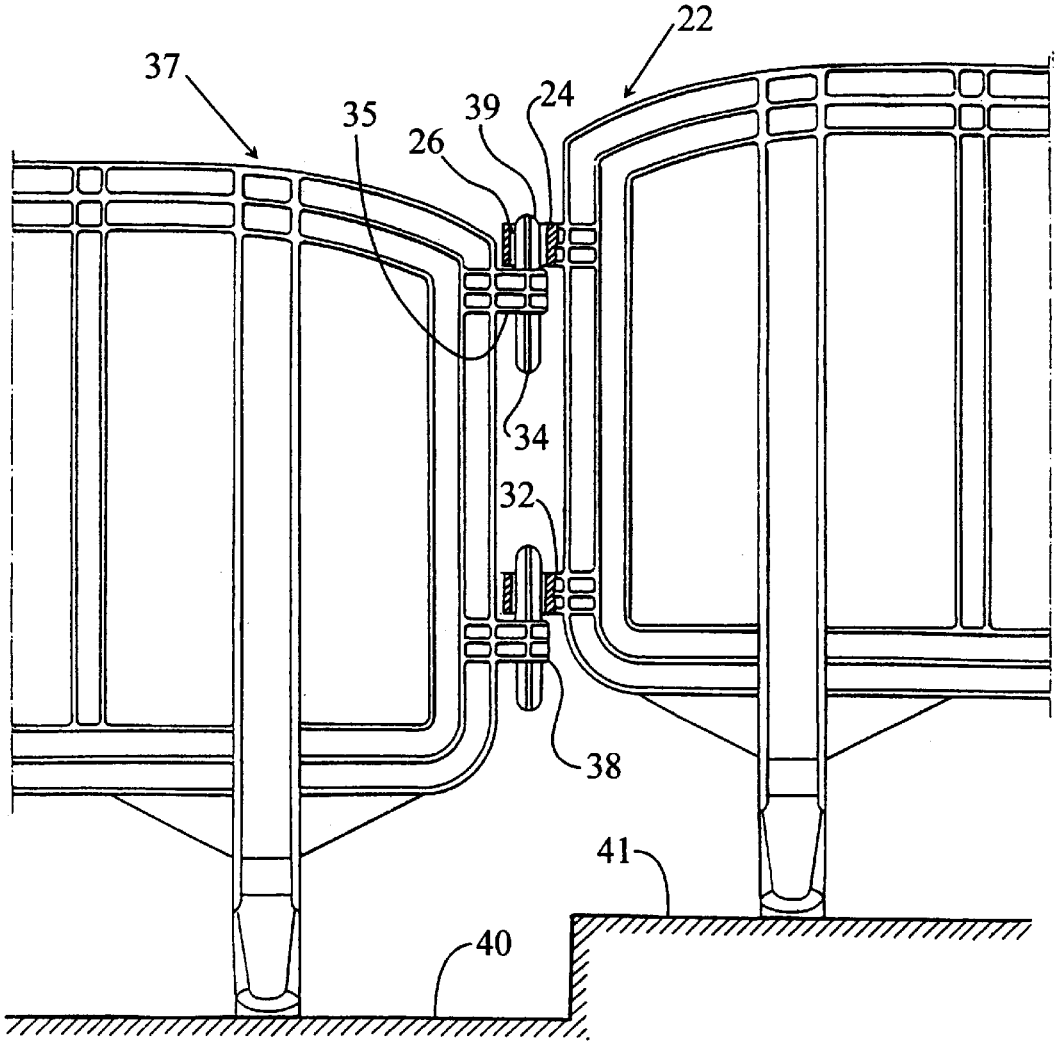
FIG. 13 is a front view similar to FIG. 12 in which the two adjacent barrier elements can be seen already coupled.

FIGS. 12 and 13 show the positions of the barrier elements when the ground has a difference in level so that one of the barrier elements, for example, that indicated 37, is disposed with its feet resting on the ground 40, which may correspond to the a roadway for traffic, and the adjacent barrier element 22 is disposed on a higher surface 41 with a height difference which corresponds to a curb. In this arrangement, it can be appreciated that, in spite of the difference in level between the two adjacent barrier elements, the rods of one of them are fitted in the holes of the adjacent one, thus giving the barrier continuity.

What is claimed is:

1. A modular separating barrier, comprising:

a substantially rectangular frame molded from synthetic material, said frame including longitudinal sides and lateral sides, shorter in length than the longitudinal sides;

an inner panel bordered by said frame, said inner panel including regions having perforations, regions having reinforcing ribs, and a plain region without perforations and reinforcing ribs; and detachable feet rotatably coupled to respective lower ends of the lateral sides;

said modular separating barrier is formed by co-extruding two materials, including an inner material of recycled synthetic material and an outer material of finishing synthetic material.

2. The modular separating barrier according to claim 1, further comprising elements disposed on the lateral sides of said frame for complementary coupling with elements of an adjacent separating barrier.

3. The modular separating barrier according to claim 2, wherein said coupling elements comprise a plurality of projections disposed on each lateral side, the projections of one lateral side each having a cavity defined therein to receive, under pressure, the projections on the other lateral side and enable an adjacent modular separating barrier to be coupled by insertion of the projections in the cavities with a capacity for articulation.

4. The modular separating barrier according to claim 1, wherein the reinforcing ribs comprise transverse corrugations in regions of said inner panel.

5. The modular separating barrier according to claim 1, wherein said longitudinal sides includes an upper side and a lower side.

6. The modular separating barrier according to claim 5, wherein at least a portion of the upper side is transversely corrugated to provide greater strength.

7. The modular separating barrier according to claim 1, wherein said separating barrier is produced by gas injection molding of a synthetic material.

8. A modular separating barrier, comprising:

a substantially rectangular frame molded from synthetic material, said frame including longitudinal sides and lateral sides, shorter in length than the longitudinal sides;

an inner panel bordered by said frame, said inner panel including regions having perforations, regions having reinforcing ribs, and a plain region without perforations and reinforcing ribs;

detachable feet rotatably coupled to respective lower ends of the lateral sides;

respective pairs of projections on each of the lateral sides, the pair of projections on one lateral side each having a substantially vertical hole defined therein, while the pair of projections on the other lateral side having coaxial rods extending in a substantially vertical direction so as to be received in the holes of the projections of an adjacent modular separating barrier, the rods have ribbed cross-sections and rounded ends.

9. The modular separating barrier according to claim 8, wherein the pair of projections of one of the lateral sides are offset in a vertical direction relative to the pair of projections of the other lateral side to permit substantially leveled insertion of the rods in the holes of an adjacent modular separating barrier.

10. The modular separating barrier according to claim 8, wherein each rod of the pair of projections includes an inner portion and an outer portion, the inner portions of the respective rods of the pair of projections being closest to one another and the outer portions of the respective rods of the pair of projections being farthest away from one another, the inner portion of each rod having a length greater than its outer portion.

11. The modular separating barrier according to claim 8, wherein the rods are of a predetermined length sufficient to enable adjacent modular separating barriers situated, respectively, at different heights to be coupled with articulation.

* * * * *

UNITED STATES PATENT AND TRADEMARK OFFICE

CERTIFICATE OF CORRECTION

PATENT NO. : 6,190,084 B1
DATED : February 20, 2001
INVENTOR(S) : Pere Mares Ibanez It is certified that error appears in the above-identified patent and that said Letters Patent is hereby corrected as shown below:

Title page,
Item [75] Inventor, change "MONCADA" to -- MONTCADA --.

Signed and Sealed this

Twenty fifth Day of September, 2001

*Attest:*

Nicholas P. Godici

NICHOLAS P. GODICI
*Acting Director of the United States Patent and Trademark Office*

*Attesting Officer*